US007320329B2

(12) United States Patent
Luke et al.

(10) Patent No.: US 7,320,329 B2
(45) Date of Patent: Jan. 22, 2008

(54) REMOTELY OPERATED CLEANING DEVICE, ESPECIALLY SUITABLE FOR STORAGE TANKS ON VESSELS

(75) Inventors: Stephen A. Luke, Youngsville, LA (US); Robert P. Luke, Youngsville, LA (US); Ben T. Deslatte, Youngsville, LA (US)

(73) Assignee: Baker Hughes Incorporated, Houston, TX (US)

( * ) Notice: Subject to any disclaimer, the term of this patent is extended or adjusted under 35 U.S.C. 154(b) by 161 days.

(21) Appl. No.: 10/942,668

(22) Filed: Sep. 14, 2004

(65) Prior Publication Data

US 2006/0054202 A1 Mar. 16, 2006

(51) Int. Cl.
*B08B 3/02* (2006.01)

(52) U.S. Cl. ..... 134/22.1; 134/22.18; 134/113; 134/167 R; 134/175; 134/177

(58) Field of Classification Search ..... 134/22.1, 134/22.18, 166 R, 167 R, 168 R, 169 R, 134/113, 174, 175
See application file for complete search history.

(56) References Cited

U.S. PATENT DOCUMENTS 3,645,452 A 2/1972 Stoeckel et al.
4,146,406 A 3/1979 Sampsell
4,201,597 A * 5/1980 Armstrong et al. ..... 134/167 R
5,518,553 A * 5/1996 Moulder ..... 134/22.18
5,594,973 A 1/1997 Brusseleers et al.
5,740,821 A * 4/1998 Arnold ..... 134/113
5,776,257 A 7/1998 Arnold et al.
6,165,283 A * 12/2000 Dahlin et al. ..... 134/21
2002/0069897 A1 6/2002 Emrey
2004/0134518 A1 * 7/2004 Kraus et al. ..... 134/18

* cited by examiner

*Primary Examiner*—Michael Barr
*Assistant Examiner*—Saeed Chaudhry
(74) *Attorney, Agent, or Firm*—Madan, Mossman & Sriram, P.C.

(57) ABSTRACT

Apparatus for remotely operated fluid pumping in work spaces, particularly suitable for the cleaning of enclosed space tanks such as those on marine vessels. The apparatus comprises one or more arm assemblies, each made up of two or more arm sections each, with the arm assembly mounted within of the tank. Hydraulic rotary actuators disposed between the arm sections provide up to 360 degree rotation of one arm section with respect to the next. A nozzle is mounted on a pair of hydraulic rotary actuators near the end of the arm assembly distal from the mount, with a hose supplying fluid from a supply pump to the nozzle. Fluids and solids from the cleaning operation can be pumped from the area being cleaned via a discharge pump to a holding vessel, such as a disposal barge. A video camera is mounted on the arm assembly, preferably at the nozzle, to permit an operator to remotely view the cleaning process and area. A control panel is preferably remotely located where an operator can fully control the device with the assistance of the video camera, including fluid flow, position of the arm assembly, and direction of fluid flow from the nozzle.

20 Claims, 7 Drawing Sheets

REMOTELY OPERATED CLEANING DEVICE, ESPECIALLY SUITABLE FOR STORAGE TANKS ON VESSELS

BACKGROUND

1. Field of Art

This application relates to remotely operated devices for the cleaning of the interior surfaces of enclosed spaces, such as storage tanks, via water or other fluid streams directed at the surface. With further particularity, this invention relates to a remotely operated apparatus especially suitable for the cleaning of storage tanks within vessels, such as ships, boats, and barges, the apparatus requiring limited human entry into the enclosed space in order to efficiently carry out the cleaning.

2. Related Art

There have been many efforts to develop semi- or fully automated cleaning devices for the cleaning of surfaces. Non-enclosed surfaces, such as flooring in a large warehouse, driveways, etc. pose no particular problem, as personnel can with relative ease and safety use a conventional hose and nozzle to direct a stream of water or other fluid onto the surface. Other applications may utilize high volume and/or pressure "pressure washers," but the task still presents relatively few issues when non-enclosed spaces are involved.

Much more significant issues arise in the cleaning of enclosed spaces or areas. Personnel entry into such enclosed spaces can be difficult, with ingress and egress often confined to relatively small hatches through which personnel and equipment must pass, often multiple times. Of much more importance are the significant safety issues which are well known in the industry to be associated with work in enclosed spaces; for example, safety issues associated with maintenance of a safe breathing environment. While various devices and procedures have been developed to address such issues, such as various breathing apparatus and the like, there remain significant hazards associated with enclosed space work.

While there are many settings in which enclosed space work arise, one common one is associated with tanks which are present on vessels used in marine service, such as boats, ships, and barges. Such tanks are usually within the "body" of the vessel, and often are used to carry different fluids from time to time; therefore, it is important to clean the interior surfaces of the tanks between uses. While not limiting the scope of the present invention, it is convenient to address the present invention in the context of the cleaning of tanks on vessels used in support of the offshore oil and gas industry, in the Gulf of Mexico and elsewhere.

Supply boats are frequently used to transport drilling mud and other products to offshore drilling rigs, in support of oilfield drilling programs associated with offshore developments. The mud holding tanks in these boats vary in size. The average size tank is generally rectangular, on the order of 15 feet by 20 feet, with corrugated walls and a wall height of twelve to fifteen feet. Some of the newer boats have round, horizontal tanks.

When drilling mud is shipped to and from the rig, some of the solids in the mud often settle out onto the floor and walls of the tanks. As a result, the tanks require interior cleaning when the boat goes off charter or when a different type of mud is to be carried in the tank.

Current methods of cleaning involve a manned entry into the tank, in order that one or more personnel can manually wash the solids from the interior surfaces out using hoses and pumps (often fire hoses fed by pneumatic diaphragm pumps). The personnel manipulate the hoses and nozzles so as to follow a desired pattern of cleaning the floor and walls of the tank. While the pattern will vary according to the degree of cleaning needed, the volume of fluid being provided for the cleaning function, etc., generally the cleaning pattern involves sequential spraying of the dirty surfaces and "pushing" (via the high pressure/volume fluid stream) the solids and contaminated cleaning fluid to one or more collection points, to suction the solids/liquids from the tank. It can be readily appreciated that for greatest efficiency, any automated system would, to the extent practicable, mimic the cleaning pattern that a person could implement.

As described above, and as can easily be understood, methods involving personnel entry into the tank are a concern to the industry due to the risk exposure and the production limitations put on the workers in the tank. The primary risk to the personnel in the tank arises out of the unsafe conditions of the inside of the typical tank on a vessel. The majority of the mud tanks have a metal, sloped floor that is covered with relatively slippery materials. The personnel are required to wear rubber boots that add to the slippery nature of the floor conditions, and in the typical scenario are required to wash the interior surfaces using a water pressured nozzle to push the solids, etc. mud to a suction hose. Additionally, the personnel are required to wear a breathing air mask with air supply attached thereto, a harness and rubber suit.

In short, these safety requirements and unsafe conditions are a great concern to the industry and need exists for improved apparatus and method for automation of cleaning of interior tank surfaces.

SUMMARY OF THE INVENTION

The apparatus and method of the present invention comprise an improved system for the remotely controlled cleaning of interior tank surfaces, especially tanks within motor vessels. The system, in one presently preferred embodiment, comprises one or more arm assemblies, each comprising a plurality of connected hinged-together arm sections. One or more of the arm sections may be telescopic. A means for rotating each arm section with respect to the next, which in a presently preferred embodiment is a hydraulic rotary actuator, is disposed at each hinge point, and permits the operator to move the arm sections in a controlled manner over effectively a large (180 to 360 degree) arc of one arm section with respect to the next. Overall, the arm assembly can be folded into a relatively compact position, for lowering with a frame and hoist assembly positioned over an access hatch, into a tank to be cleaned. Once the arm assembly is inside the tank, it is moved (via a conveyor assembly, such as an overhead track mounted in the tank, with the arm assembly suspended from the track via a sliding or rolling carriage) and positioned at a mount on the inner surface of the tank. The mount may be positioned on a wall, the floor, or the ceiling of the tank. Alternatively, the arm assembly may be dismantled (for example, into the separate arm sections) and installed piece by piece, if no conveyor assembly is in place within the tank. Yet another alternative embodiment mounts within the access hatch, requiring no personnel entry into the tank. A fluid nozzle is mounted near the end of the arm assembly distal from the mounting point, with a hose routed down the arm assembly to the nozzle. A pump capable of relatively high volume and pressure output supplies fluid (water, chemicals, or other desired fluids) through the hose to the nozzle. A video camera is mounted on the arm assembly, preferably near the nozzle, to permit an operator to remotely view the cleaning process and area. In addition to or in lieu of the nozzle, a suction assembly may be mounted on the arm assembly. Additional cameras may be mounted within the tank. A control panel, preferably contained within a control room, is remotely located where an operator can fully control the apparatus, including fluid flow, suction hose (if any), position of the arm assembly, and direction of fluid flow from the nozzle. In a presently preferred embodiment, an umbilical carries the video signal from the camera to the control panel, and also contains hydraulic supply to the rotary actuators and control lines to the rotary actuators from the control panel. The very large arc through which the individual arm sections can move, and the manner in which the arm sections are connected, the mounting of the nozzle preferably on dual rotary actuators, yield 4 axes of movement of the nozzle. Telescopic capability of the arms adds still more flexibility of movement. All of these structural attributes and controls permit replicating the cleaning pattern that a human would effect within the tank.

The contaminated solids/fluid mix resulting from the cleaning process can be pumped from the tank via a discharge pump to a holding vessel, such as a disposal barge. Although limited personnel entry may be required to mount and dismount the arm assembly at the start and end of cleaning jobs, the remainder of the job may be carried out remotely and at least partially automated.

DETAILED DESCRIPTION OF THE PREFERRED EMBODIMENTS

The present invention, in a broad sense, is directed to apparatus and method for a remotely operated system for the application of fluid streams onto surfaces. It is understood that the scope of the present invention encompasses applications in both enclosed and non-enclosed spaces, although it has particular application in enclosed spaces. The present invention is suitable for use in performing a number of different services, including but not limited to hydro blasting, sand blasting and chemical spraying, vacuum or suction device positioning, in any type of enclosed or non-enclosed space. For illustrative purposes only, and for convenience in setting forth one of the presently preferred embodiments of the invention, the invention will be described in connection with the cleaning of tanks on vessels, in particular example those tanks associated with the drilling industry, wherein those tanks are used in the transport of drilling muds. With reference to the drawings, some of the presently preferred embodiments are now described.

Figure 1:
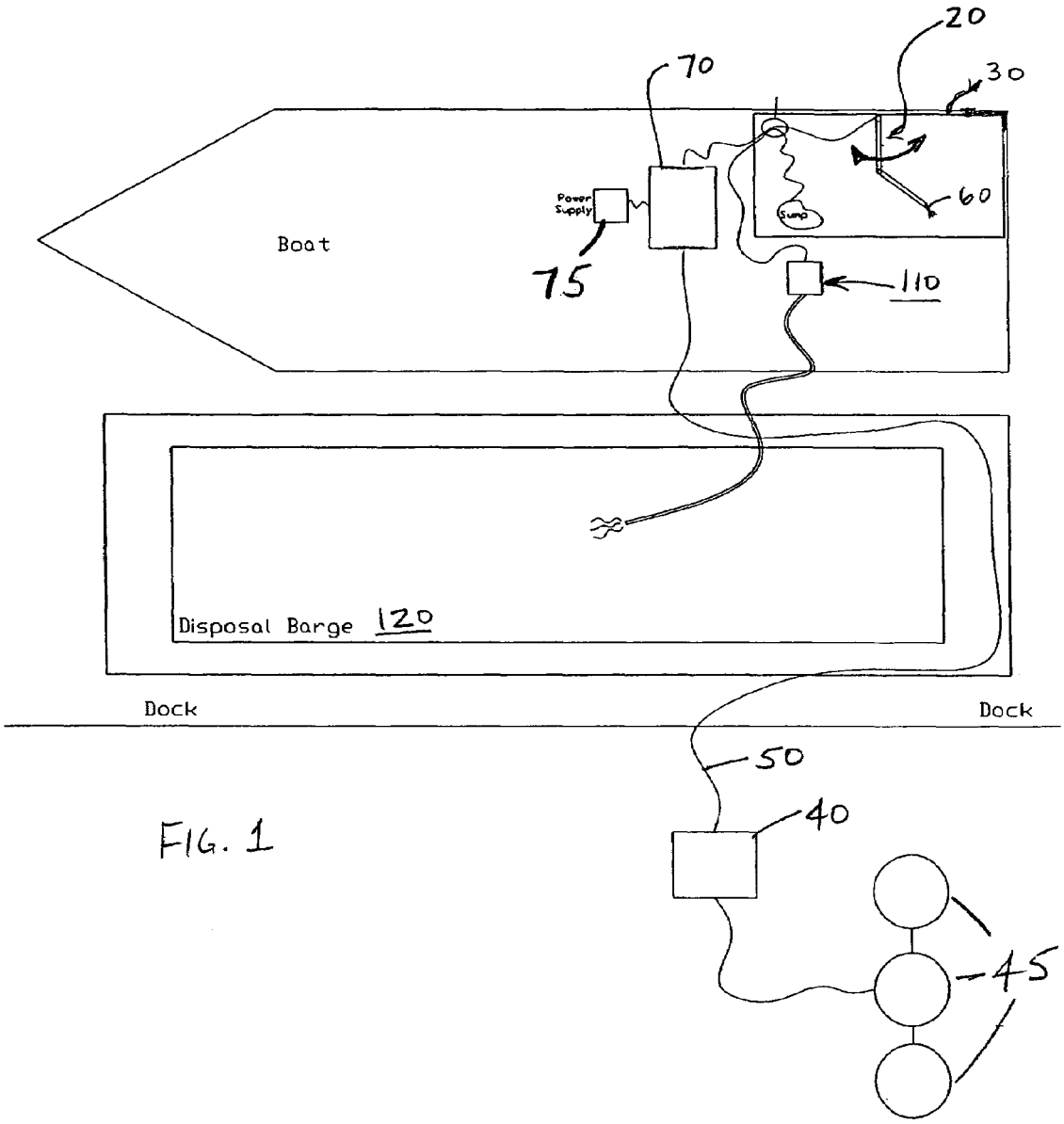
FIG. 1 is an overhead view of a typical application of the present invention being used to clean a tank on a vessel.

Referring to FIG. 1 for an overall view of one application of the present invention, the invention comprises at least one arm assembly 20 adapted to be mounted on an interior surface of an enclosed area, for example mud tank 30. A supply pump 40, supplies fluid, for example water, at relatively high rate and pressure through hose 50 to arm assembly 20, and ultimately to nozzle 60, as better seen in FIGS. 2-5 and described in more detail hereinafter. Supply pump 40 may comprise any pump capable of energizing nozzle 60. Supply pump 40 can supply any type of fluid or media such as water, recycled water, drilling mud or chemical, for example from supply tanks 45. While many different types of pumps may suffice, and can range in pressure and rate capability, an exemplary supply pump is a motorized centrifugal pump that can achieve high pressure and volumes. Ultra high pressure and large volume pumps along with pumps designed to pump heavy mud products may also be used. In addition to nozzle 60, or in lieu thereof, a suction or vacuum outlet may be mounted near the location of nozzle 60. In such configuration, a vacuum pump would connect to the suction or vacuum outlet.

A control panel 70 is conveniently yet remotely positioned with respect to the tank, and is preferably disposed within an enclosure such as a control room. Electrical power, etc. as required are supplied to the control panel. In addition, a hydraulic power supply 75 provides pressurized hydraulic fluid to the components, especially the hydraulic rotary actuators, of arm assembly 20. In other embodiments of the invention, electric AC/DC drive actuators may be used, in which case suitable electric power is supplied to the drives and controlled at the control panel.

Figure 2:
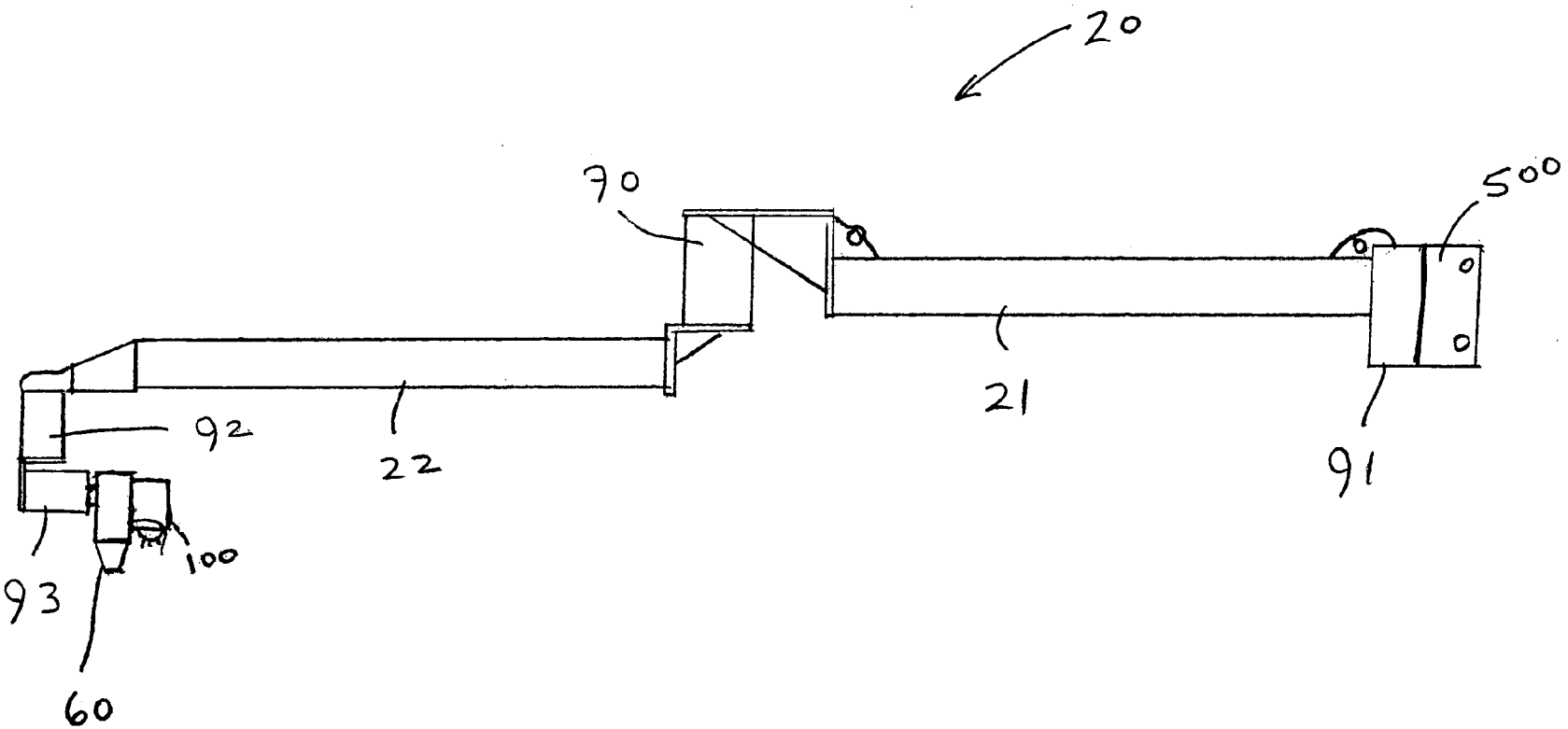
FIG. 2 is a more detailed view of the arm assembly.

Controls mounted on control panel 70 are operatively connected to arm assembly 20, and more particularly to a means for rotating arm sections 21 and 22 with respect to one another. It is understood that one or both of arm sections 21 and 22 may be telescopic, i.e. may be longitudinally extended or retracted, as controlled by the operator. In a presently preferred embodiment, the means for rotating the arm sections comprises rotary hydraulic actuators 90 disposed between arm sections (as shown in FIG. 2), and permit manipulation of the arm sections in a desired direction. In yet other embodiments, the means for rotating the arm sections comprises electric AC/DC actuators. Similar means for rotating connect arm section 21 to mount 500, again hydraulic actuator 91. Video camera 100 is mounted on arm assembly 20, preferably near the end of arm assembly 20 distal from the mounting end, and is connected to control panel 70 so as to transmit a video signal to control panel 70. By this means, an operator stationed at control panel 70 can both remotely operate arm assembly 20, and view the interior of the tank to detect areas still in need of cleaning, etc. Additional cameras may be mounted in different locations within the tank to permit other views from other angles within the enclosed area.

Nozzle 60 is mounted to arm section 22 by one or more means for rotating nozzle 60. In a preferred embodiment, as seen in FIG. 2, two hydraulic rotary actuators 92 and 93, each having an axis of rotation at right angles to one another, are used. This permits very much enhanced ability to direct fluids from nozzle 60 in a desired direction. As with the rotating means joining the arm sections, the means for rotating nozzle may alternatively comprise electric AC/DC actuators.

It is understood that means for rotating 90 through 93 may comprise various structural elements (for example, simple king pin type arrangements to carry vertical and horizontal loads and torque; coupled with hydraulic cylinders with offset moment arm mounts, etc.), but in the preferred embodiment comprise rotary hydraulic actuators. These devices combine the required structural connection between arm sections, between the arm assembly and the mount (described in more detail below), and between the nozzle and the arm assembly, with the ability to induce rotation between the parts so connected, in a powered yet controlled manner. While various manufacturers may make suitable devices, one manufacturer which makes hydraulic rotary actuators is HELAC Corporation in Enumclaw, Wash., USA, in particular the "L" series models. It is understood that various other means for rotating could be used, and would fall within the scope of the present invention. As mentioned above, electric AC/DC actuators may also provide suitable structural capability while at the same time provide suitable motion and braking capability.

A second pump, denoted as discharge pump 110, can be used to pump out contaminated fluids and solids resulting from the cleaning, into another container for disposal, for example into disposal barge 120. Preferably, discharge pump 110 comprises a self-priming centrifugal pump, although it is understood that other types of pumps, for example a pneumatic diaphragm pump, are also suitable.

Figure 3:
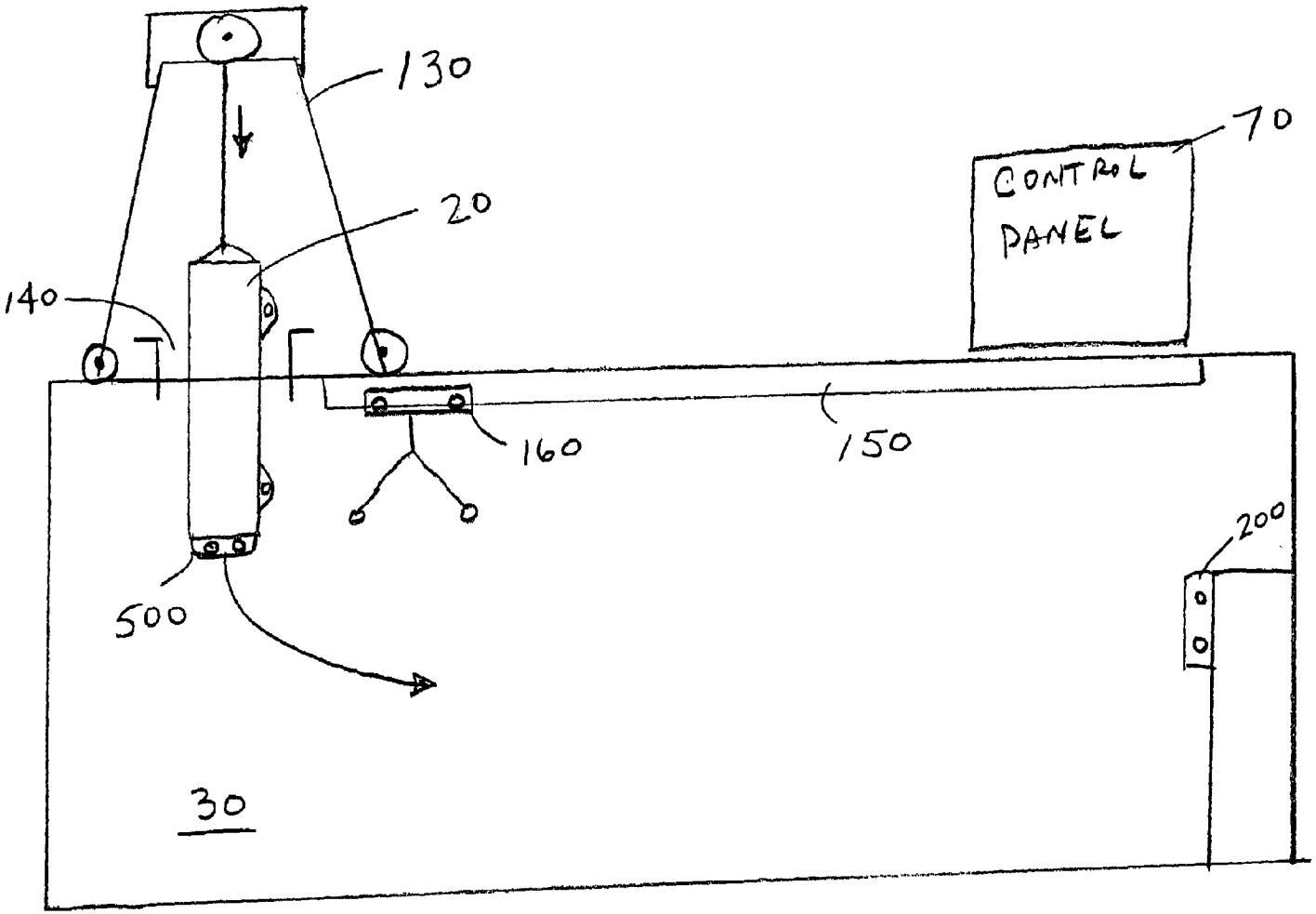
FIG. 3 shows the first stage of lowering the arm assembly into a tank, in preparation for mounting therein.
Figure 4:
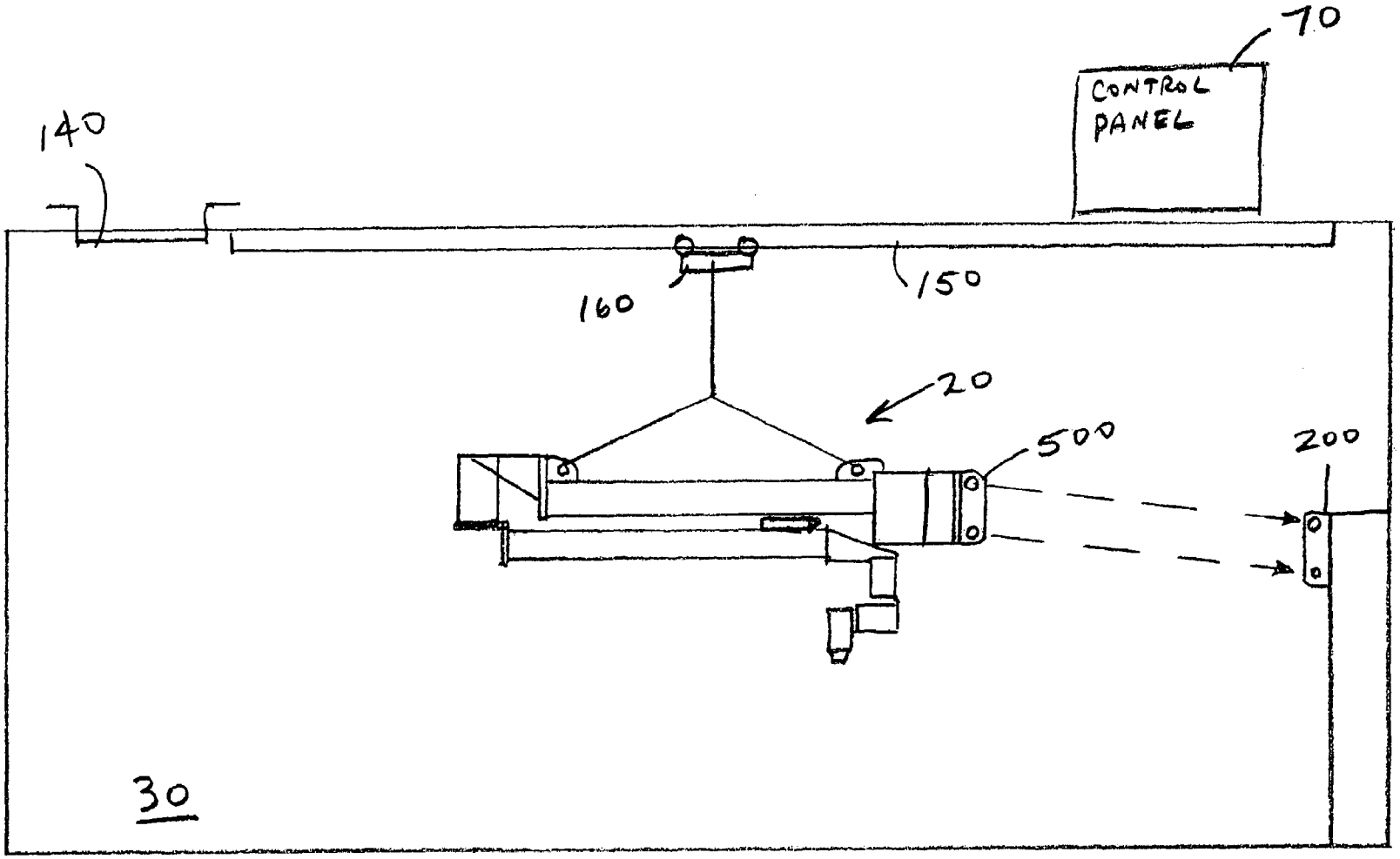
FIG. 4 shows a later stage of moving the arm assembly via the track and carriage, into position for mounting to the bracket.
Figure 5:
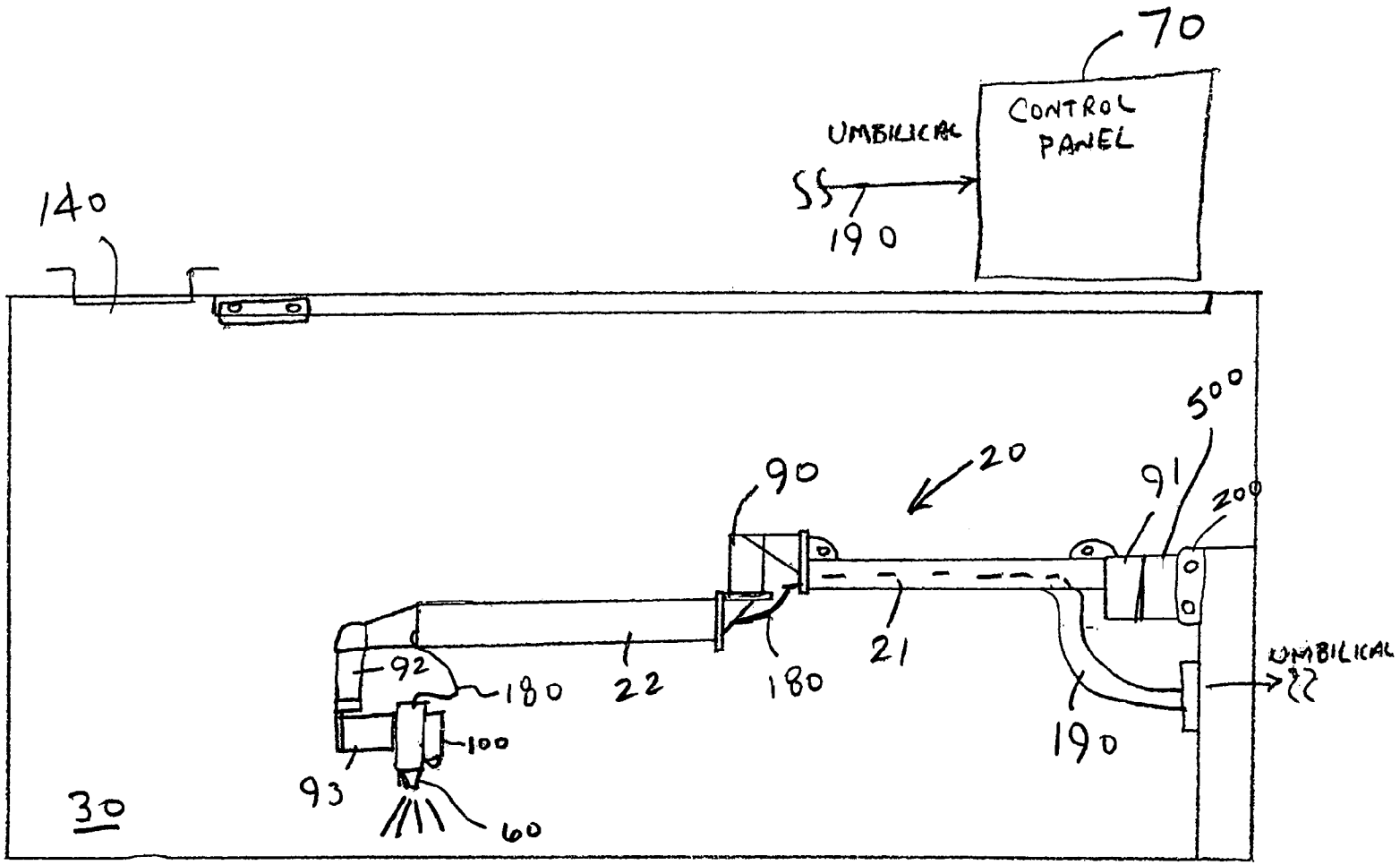
FIG. 5 shows the arm assembly mounted on the bracket.

Referring to FIGS. 3-5, one presently preferred embodiment of the system of the present invention is described in more detail. These three figures are cross section views of a typical mud tank 30. FIG. 3 shows an early step in the placement and mounting of arm assembly 20 into tank 30. Arm assembly 20 is folded together to make a relatively compact, easy to handle package (it is to be understood that FIG. 4 better shows the folded-together arm assembly 20, while the element denoted as arm assembly 20 in FIG. 3 eliminates some detail for simplification). A means for lowering arm assembly 20 into tank 30 is provided, for example frame and winch 130, to lower the assembly through access hatch 140. Inside tank 30 is a means for conveying arm assembly 20 to mount 200, which in a presently preferred embodiment comprises a track 150 and carriage 160. Carriage 160 may ride on track 150 via wheels or rollers, or may simply be a sliding mounting thereon. It is understood that the design of arm assembly 20 permits it to be readily disassembled into the multiple arm sections (here, elements 21 and 22), and moved into tank 30 by hand (carried by personnel), and therein mounted in place.

FIG. 4 shows arm assembly 20 suspended from carriage 160, and being moved along track 150 so that bracket 500 can be stabbed into mount 200, and secured there by pins, bolts or the like. It is understood that some of the elements of the invention are not numbered in FIG. 4, for clarity.

FIG. 5 shows arm assembly 20 in position (mounted in tank 30), and in an extended position, with hose 180 supplying fluid to nozzle 60. Umbilical 190 carries a video signal to control panel 70, along with hydraulic supply hoses to means for rotating 90-93. It can be readily seen that by rotation of the means for rotating 90-93 (hydraulic rotary actuators, in the preferred embodiment), nozzle 60 can be directed to desired locations and direction of flow within tank 30, to mimic a human operator inside tank 30. This is done without the need for human entry into tank 30 (except perhaps to mount arm assembly 20 within the tank, and to connect the umbilical).

The advantages of the present invention can be readily seen. Other than limited entry of personnel to mount and dismount arm assembly 20 and its associated equipment, operation of the system is done remotely, by an operator at control panel 70. The operator can bring nozzle 60 to bear in nearly any desired point within tank 30, and push fluids and solids to discharge pump 110. The significant safety hazards with personnel in an enclosed space are largely avoided. In addition, since the arm assembly 20 is capable of manipulating a nozzle/hose combination moving a much higher volume and pressure of fluid than can a human, cleaning time can be very much shortened.

Figure 6:
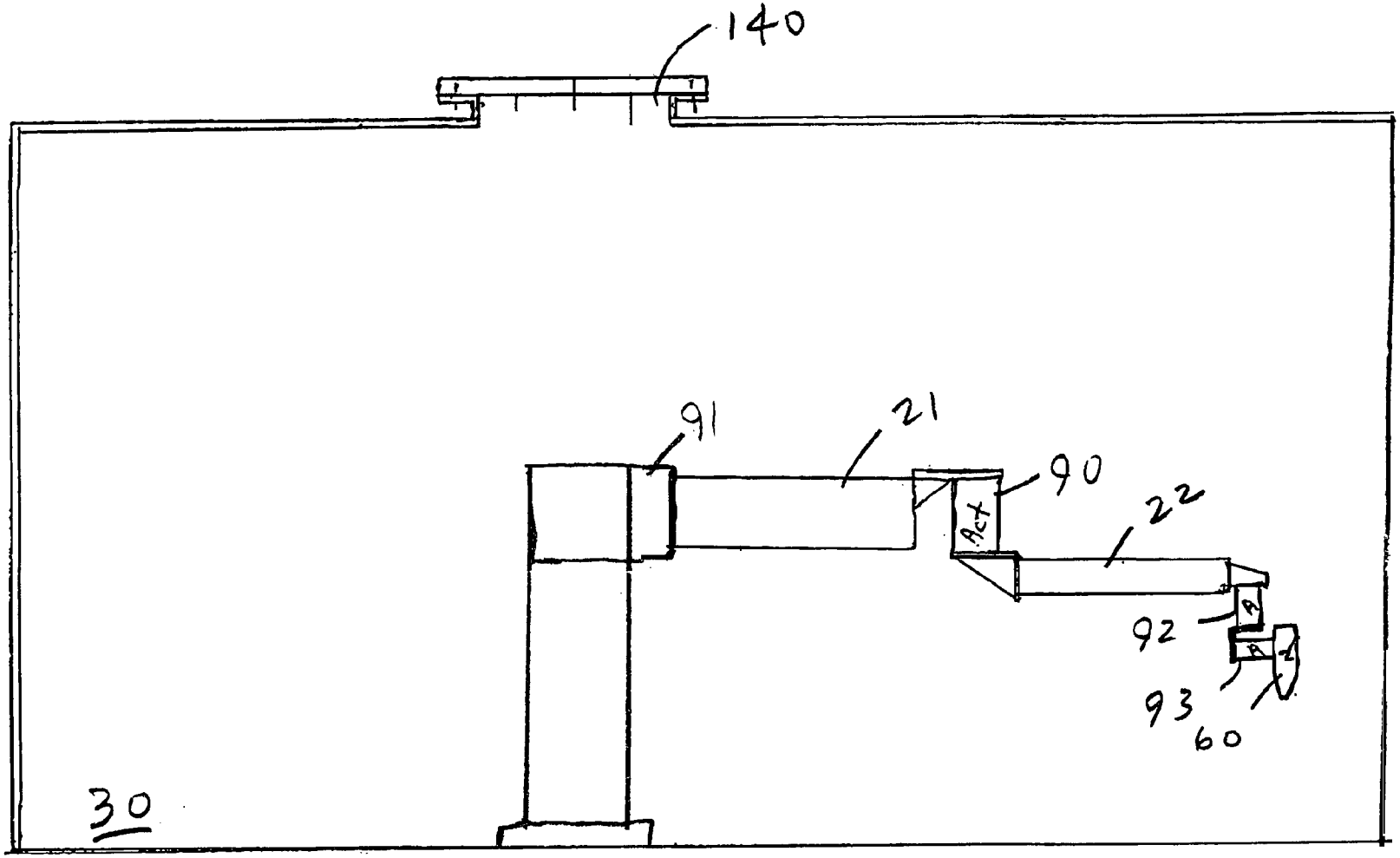
FIG. 6 shows a pedestal mount embodiment.

Mount 200 may be disposed on a wall, the floor, or the ceiling of the tank. In the preferred embodiment of the invention, mount 200 is mounted in a more-or-less permanent manner within the tank, and remains in the tank between cleaning jobs. In this way, only arm assembly 20 need be removed and replaced between jobs. Alternative mounting configurations include mounts fixed to the ceiling of the tank, or a pedestal mount on the floor of the tank. One advantage to a floor pedestal mount (in particular, more or less in the center of the floor) is that full 360 degree rotation of the arm assembly would be possible; other mounts, for example wall or ceiling mounts, may be limited to on the order of 180 degree of rotation at the first point of rotation (that is, next to the mount). FIG. 6 shows one simplified view of a center pedestal mount.

Figure 7:
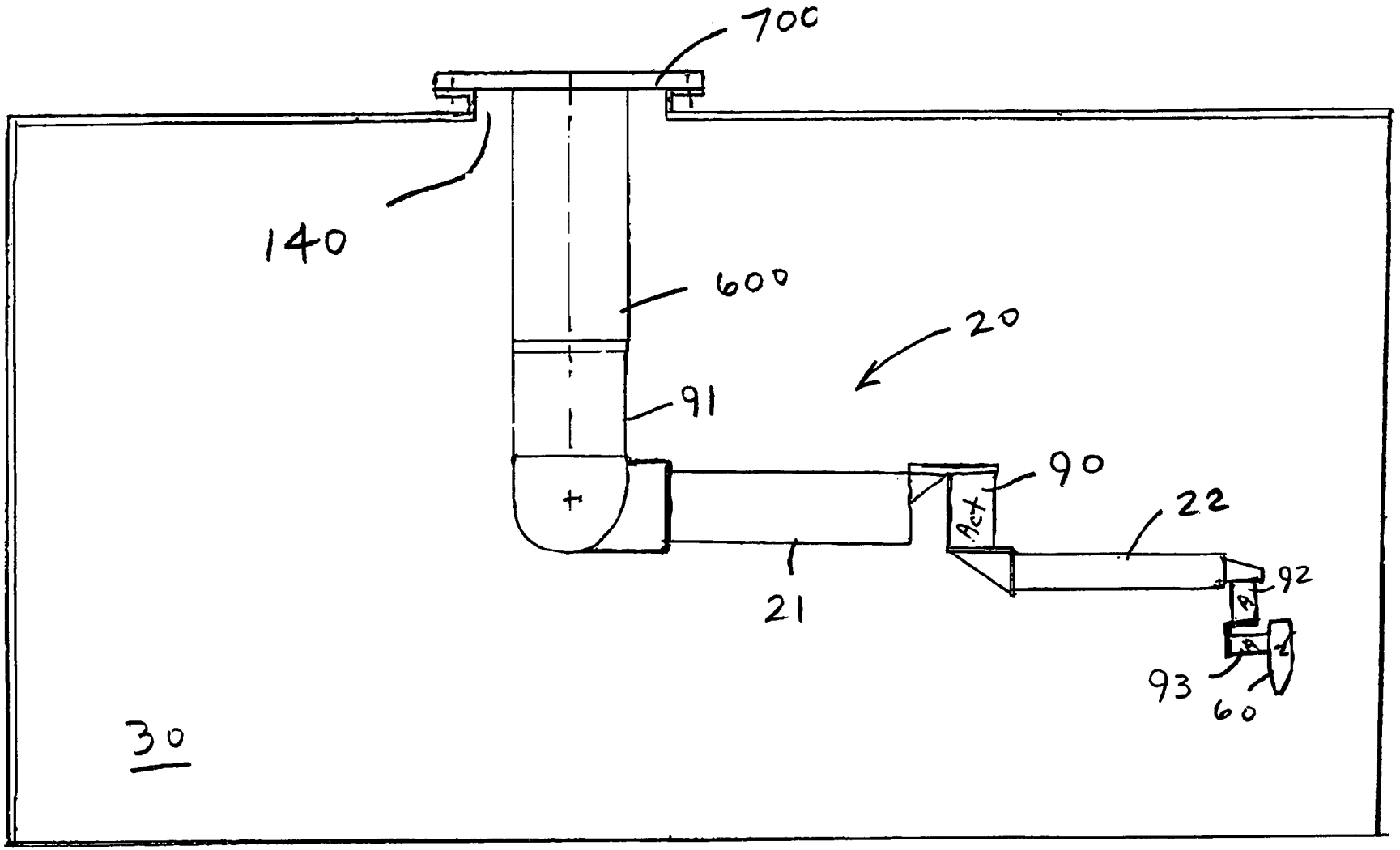
FIG. 7 is another embodiment of the apparatus, which mounts within the access hatch to the tank.

FIG. 7 shows another embodiment of the invention, in which no personnel entry into the tank is needed. Arm assembly 20 is lowered through access hatch 140 (generally disposed at the top of the tank), and mounts in the access hatch, for example via a mounting plate assembly 700; effectively, an inverted pedestal 600 suspends arm assembly. This embodiment may have significant advantages in certain settings, by virtually eliminating personnel entry into the tank, and permitting the 360 degree rotation of the pedestal, while not requiring any obstruction (for example, as with a floor mounted pedestal) in the tank.

While the preceding description sets out many specificities, it is to be understood that same are made by way of describing some of the presently preferred embodiments and not by way of limitation. Various changes could be made to the apparatus while still falling within the scope of the present invention. For example, the following changes comprise embodiments that fall within the scope of the present invention:

- the arm assembly could comprise two, three or more arm sections
- one or more of the arm sections can be longitudinally telescopic
- more than one arm assembly could be mounted in a tank
- dimensions and materials can be varied to accommodate particular applications
- the degree of automation of any particular system can be varied or altered as desired.
- the arm assembly could be mounted on a wall, the ceiling, or the floor of the tank, or mounted in the access hatch
- the means for conveying arm assembly to the mount could comprise a sliding or rolling carriage mounted on an overhead, side mounted, or floor mounted rail; or could be some form of rolling, wheeled apparatus within the tank; or alternatively, could be disassembled and carried into the tank by personnel
- various types of means for rotating the various parts of the assembly, one to the next, could be used, and could be hydraulic, pneumatic, mechanical, electric (AC/DC) or other equivalent mechanisms
- different tools could be mounted on the arm assembly, e.g. nozzles, cameras, suction heads
- the system could be used to clean tanks and other surfaces, whether enclosed or not, by spraying a variety of different fluids, including but not limited to water, soaps, other cleaning solutions; or could be used in a hydroblasting application.

Therefore, the scope of the invention is not to be measured by the specific embodiments set out above, but by the scope of the appended claims and their legal equivalents.

We claim:

1. An apparatus for remotely controlled cleaning of the interior of tanks, comprising:

a) at least one arm comprising a plurality of arm sections;

b) a nozzle mounted on said arm and fluidly coupled to a hose;

c) plurality of rotary actuators disposed on said arm, the plurality of rotary actuators cooperating to rotate said nozzle around at least three axis;

d) a video camera mounted on said at least one arm;

e) a supply pump coupled to said hose; and f) a control panel comprising a video signal receiver connected to said video camera, and controls operatively connected to said plurality of rotary actuators.

2. The apparatus of claim 1, further comprising a discharge pump pumping said materials out of said tank.

3. The apparatus of claim 2, further comprising a holding tank receiving materials pumped by the discharge pump.

4. The apparatus of claim 1, wherein said plurality of rotary actuators comprises at least one a hydraulic rotary actuator.

5. The apparatus of claim 1, wherein said plurality of rotary actuators includes at least one rotary actuator associated with at least one of said arm sections and a set of at least two rotary actuators associated with said nozzle.

6. The apparatus of claim 1, wherein at least two of said plurality of rotary actuators are at right angles to one another.

7. The apparatus of claim 1, wherein said plurality of rotary actuators comprises at least one electric rotary actuator.

8. The apparatus of claim 1, further comprising a suction head mounted on said arm, said suction head coupled to a discharge pump.

9. The apparatus of claim 1, further comprising a pedestal attached to a floor of said tank and extending upwardly from said floor, the arm being removably attached to said pedestal.

10. The apparatus of claim 1, wherein one or more of said arm sections are telescopic.

11. A system for cleaning the interior of tanks, comprising:

a) at least one arm assembly comprising:

i) a plurality of connected arm sections hinged one to the next, one end of said arm assembly terminating in a mount;

ii) hydraulic rotary actuators disposed between each of said arm sections, manipulation of said hydraulic rotary actuators permitting rotational movement of arm sections relative to one another;

iii) a video camera mounted on said at least one arm assembly; and iv) a nozzle mounted on said arm assembly via at least one hydraulic rotary connector, and fluidly coupled to a hose;

b) a means for lowering said arm assembly into a tank;

c) a means for conveying said arm assembly to a mount disposed within said tank, and positioning said arm assembly for connection to said mount;

d) a supply pump coupled to said hose; and e) a control panel comprising a video signal receiver and controls operatively connected to said hydraulic rotary actuators.

12. The system of claim 11, further comprising a discharge pump disposed in said tank and positioned to receive solids and liquids resulting from cleaning of said tank, and discharge same outside of said tank via a hose coupled to said discharge pump.

13. The system of claim 12, wherein said means for lowering said arm assembly comprises a winch mounted on a movable frame.

14. The system of claim 11, wherein said means for conveying said arm assembly to said mount comprises a track disposed in said tank and a movable carriage mounted on said track, said arm assembly suspended from said carriage.

15. An apparatus for remotely controlled cleaning of the interior of a tank comprising:

a) at least one arm comprising a plurality of arm sections, one end of said arm attached to a downwardly-depending pedestal inserted into an access hatch in the tank and extending downwardly into said tank;

b) a nozzle mounted on said arm and fluidly coupled to a hose;

c) plurality of rotary actuators interposed along said arm, the plurality of rotary actuators cooperating to rotate said nozzle around at least three axis;

d) a video camera mounted on said at least one arm;

e) a supply pump coupled to said hose.

16. A method of cleaning the interior of tanks, comprising the steps of:

a) providing an apparatus comprising: at least one arm having a nozzle at an end thereof b) conveying said arm to a mount disposed within said tank, and connecting said arm to said mount;

c) pumping a fluid through said nozzle using a supply pump;

d) directing said fluid to a desired location and direction by rotating said nozzle about at least three axis using a plurality of rotary actuators; e) pumping materials resulting from the cleaning out of said tank using said discharge pump;

f) visually monitoring the cleaning using a video camera positioned on the arm; and g) remotely controlling the arm using a control panel.

17. A system for cleaning an interior of a tank having a mount, comprising:

a) an arm terminating at the mount, the arm comprising:

i) a video camera mounted on said arm;

ii) a nozzle mounted on said arm; and iii) at least two rotary actuators associated with said nozzle, wherein actuation of said at least two rotary actuators rotates said nozzle;

b) a track removably positioned in the tank;

c) a carriage slidably coupled to the track, said carriage conveying said arm to the mount;

d) a supply pump coupled to said hose; and e) a control panel comprising a video signal receiver and controls operatively connected to said hydraulic rotary actuators.

18. The apparatus of claim 17, further comprising at least one rotary actuator associated with said arm.

19. The apparatus of claim 17, wherein the at least two actuators are at right angles to one another.

20. The apparatus of claim 17, wherein said plurality of rotary actuators comprises one of: (a) an electric rotary actuator; (b) a hydraulic rotary actuator; and (c) a pneumatic rotary actuator.

* * * * *